US005186885A

United States Patent [19]

Perneczky

[11] Patent Number: 5,186,885

[45] Date of Patent: Feb. 16, 1993

[54] APPARATUS FOR COOLING A TRAVELING STRIP

[76] Inventor: George C. Perneczky, 14032 S. Kostner Ave., Unit H, Crestwood, Ill. 60445

[21] Appl. No.: 601,197

[22] Filed: Oct. 22, 1990

[51] Int. Cl.[5] ..... C21D 9/52

[52] U.S. Cl. ..... 266/115; 266/102

[58] Field of Search ..... 266/102, 111, 113, 115, 266/134, 258, 251; 239/553.3, 566, 568, 590.3, 597; 432/8, 59

[56] References Cited

U.S. PATENT DOCUMENTS 2,521,044 9/1950 Cooper et al. ..... 266/111
3,186,694 6/1965 Beggs ..... 432/8
3,342,649 9/1967 Morgan ..... 266/111
4,625,431 12/1986 Nanba et al. ..... 266/111

FOREIGN PATENT DOCUMENTS 61-127826 6/1986 Japan ..... 266/113

*Primary Examiner*—Scott Kastler

[57] ABSTRACT

The present invention relates to an apparatus for cooling a traveling strip of heated material. The apparatus includes a cooling header comprising an external pipe having disposed therein a plurality of internal pipes having discharge holes. The external pipe has an exit which communicates with the discharge holes, and further includes a first chamber which communicates with a source of air and a second chamber which communicates with the first chamber and the internal pipes.

20 Claims, 3 Drawing Sheets

APPARATUS FOR COOLING A TRAVELING STRIP

BACKGROUND OF THE INVENTION

1. Field of the Invention

The present invention relates generally to an apparatus for cooling a heated strip of material such as a metal. The invention may be advantageously employed in such operations as, for example, a hot dip galvanizing line. The heated material is cooled by an apparatus which provides a uniform discharge of low-pressure, high velocity air on the material as the material travels adjacent the apparatus.

2. Description of the Prior Art

The coating of traveling sheet stock is old in the art. For example, galvanizing operations of steel sheet stock has been developed to prevent oxidation of the sheet metal later used to manufacture finished consumer products, such as garbage cans, air ductwork, storage tanks, and the like.

Generally, the galvanizing operations consist of coating the strip by dipping it in a molten bath of zinc, an alloy of zinc and one or more other metals, and optionally, other minor additives. The zinc coating operations have evolved from a single sheet (i.e., batch) process to the present-day continuous coating lines, commonly known as "CC lines". Generally, the CC lines in use today include five process steps. The first step involves a cleaning process which prepares the steel strip (for example, by degreasing) for coating. The second step is an annealing process, which endows the steel strip with good formability. The third step is a dipping process, in which the steel strip is dipped into a zinc bath to provide the protective coating. The fourth step is a chemical treating process, which protects the zinc coating from storage stains. The fifth step is the working and leveling process, which ensures uniform forming.

When the steel strip is zinc-coated in the hot dip step, the preheated strip generally travels downwardly from an annealing furnace into a bath of molten zinc where the surfaces of the strip are coated. The steel strip is thereafter turned upwardly by a sink, or guide, roller and leaves the molten zinc bath vertically. On leaving the bath, the strip is passed between opposed surfaces of air knives. The air knives provide a continuous blast of highpressure air to remove any excess molten zinc from the strip. At the time the coated strip exits the air knives, the zinc coating on the strip is still in a substantially liquid (i.e., molten) state.

As the strip continues traveling upwardly toward a deflector roller, often referred to as a tower roller, the temperature of the ambient air cools the strip and the zinc coating solidifies. During this solidification, the characteristic surface crystal design pattern, called "spangle", routinely seen on galvanized articles is formed. The rate of cooling determines the spangle pattern; if cooling is strictly by ambient air, large spangle patterns are formed. Galvanized products having large spangle patterns have a limited market for products in those areas where surface texture is unimportant. However, for consumer products, such as home appliances, office furniture, auto bodies, steel siding for homes and manufacturing facilities and the like, surface texture is an important feature. Many of these consumer products require a paint or other type of finish in addition to the galvanizing process. The large spangle pattern often shows through such finish as surface imperfections and is, thus, not desirable for many consumer product uses.

To prevent large spangle patterns from forming, attempts have been made by galvanizers to cool quickly the zinc and solidify it in a sudden manner by spraying air-atomized water on the strip exiting the air knives. This approach creates smaller spangle patterns; these smaller patterns are commonly referred to as "mini-spangles". However, even the "mini-spangles" are unacceptable in some consumer products due to the appearance of surface imperfections on the finished surfaces.

In related applications, the hot dip galvanizing industry introduced the use of an annealing furnace positioned immediately above the air knives. The purpose of this annealing furnace is to alloy the zinc and its additives to the material of the strip while the strip is passing through the annealing furnace. However, in such operations, the strip exits the annealing furnace at temperatures approaching 1100° F., which is far above the melting temperature (about 800° F.) of the zinc and its additives. The 1100° F. temperature strip travels in a vertical direction toward the tower roller. As this hot strip wraps around the tower roller at a temperature near or above the melting temperature of the zinc, some of the zinc is deposited on that roller; this oftentimes results in a smearing of the remaining zinc on the face of the strip. This situation has also caused the unacceptable appearance of imperfections on the surface of the strip.

A further problem that has occurred is that as the tower roller becomes smeared with zinc, the tower roller eventually needs to have the zinc removed, such as by grinding, from the roller. Usually the grinding process is performed by an individual who stands next to the roller and uses a hand-held grinder against the surface of the roller. This operation presents significant safety concerns. For example, the individual is exposed to the extreme heat of the traveling strip. Also, because the grinding operation is often performed while the line continues to operate, the roller is rotating at a significant speed, thereby raising the prospect that the individual could be drawn into the roller and injured.

Faced with these problems, the industry has attempted to cool the strip between the annealing furnace and the tower roller by blowing low-pressure, low-velocity air on the strip in large volume and large cross-section from a single air header. By so cooling the strip, the size of the spangle could, in theory, be reduced. Thus, the galvanized steel would be of a better quality for consumer products.

In this prior art design, the large volume, low-pressure, low-velocity air makes contact with the strip in a relatively large area, with the air header being positioned in front and in back of the traveling strip, so that the air stream exiting the header is usually wider than the strip width.

In the cooling approach used by this prior art design, the cooling air first makes contact with the strip as the strip enters the entry end of the cooler. Because the strip at this point is generally about 110° F., the air quickly becomes superheated. The superheated air then forms a boundary layer next to the strip and travels upward with the strip, at the speed of the traveling strip. As will be appreciated, the boundary layer of the superheated air acts as an insulator. Thus, the large volume, low-pressure, low-velocity air being directed toward the strip at points above the entry end is unable to break through the superheated boundary layer air to further cool the strip. Therefore, this method of attempting to cool the strip is inefficient because only the air that first contacts the strip at the entry end is able to perform any significant cooling. Furthermore, this cooling process is energy inefficient because large volumes of air are delivered to the strip that have very little, if any, cooling value past the entry point.

Because the air flow in this prior art approach is directed at the strip at a 90° angle, the air that bounces back from the strip creates a turbulent zone immediately adjacent to the traveling strip. The cooling of the strip is thus further hindered because the edges of the strip naturally cool faster than the center of the strip. This non-uniform cooling of the strip has several disadvantages. First, the edges of the strip may become wavy and the sizes of the spangles could be different across the face of the strip. Second, this cooling process is also inefficient in that the temperature of the strip generally cannot be reduced to a sufficient level where the zinc fully solidifies and "freezes" on the strip prior to wrapping around the tower roller. Consequently, in such operations of the galvanizing lines, the temperature of the strip may be about 700°-800° F., after going through this type of air-cooling apparatus. This high temperature causes the phenomena described earlier, i.e., the molten zinc is deposited on the tower, and sometimes even subsequent rollers, additionally causing a smeared surface on the strip.

With this general discussions of the problems associated with the prior art in mind, it is a nonlimiting object of the present invention is to provide an apparatus for cooling a coated strip of material which does not have the inherent deficiencies of the prior art.

Another nonlimiting object of the present invention is to provide a cooling apparatus which reduces the temperature of the strip from approximately 1100° F. to about 300° F. prior to contacting deflector rollers.

Yet a further nonlimiting object of the present invention is to provide a cooling apparatus which harvests the heat energy from the superheated air deflecting away from the strip to generate steam.

These nonlimiting described objects and the other objects and advantages of the present invention will become apparent to those skilled in the art with reference to the foregoing, the attached drawings, and the description of the invention which hereinafter follows.

SUMMARY OF THE INVENTION

The present invention provides an apparatus for use in cooling a coated strip of material. The apparatus comprises cooling headers that uniformly discharge low-pressure, high-velocity air onto the strip after the strip has been coated and before the strip passes over deflector rollers.

DESCRIPTION OF THE PREFERRED EMBODIMENT

The present invention relates to an apparatus for use in rolling mills and, in particular, to an apparatus for use in cooling a traveling strip of coated material.

Figure 1:
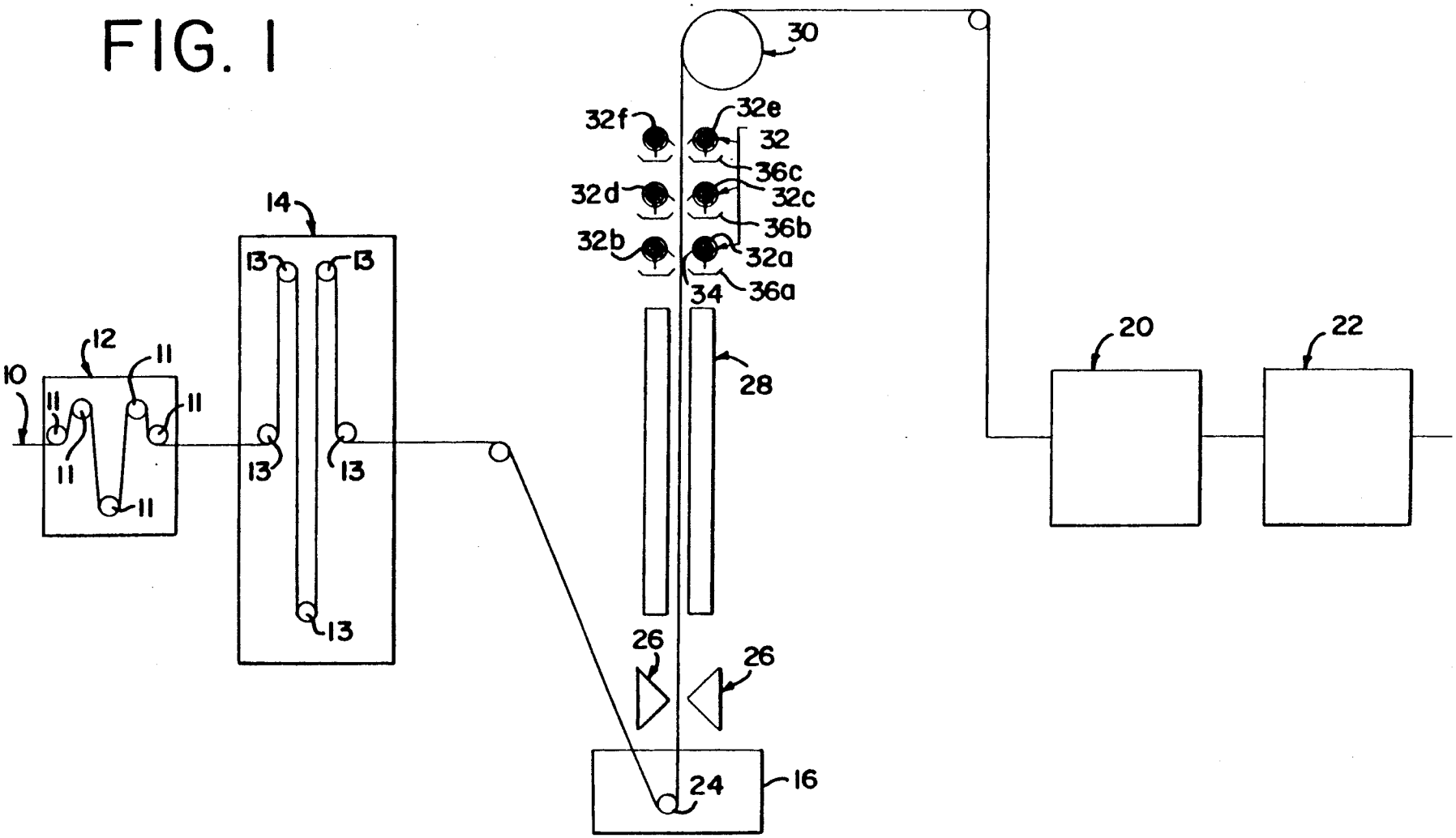
FIG. 1 is schematic representation of a section of a continuous coating line typically found in rolling mills of the steel industry.

FIG. 1 depicts a section of a continuous coating line typically found in rolling mills of the steel industry. The continuous coating line may be, for example, a galvanizing line, and generally includes five process components or steps. First, the surface of a strip 10 is cleaned, such as by degreasing, in cleaner 12 provided with a series of guide rollers 11. The cleaning step and the cleaner 12 are known in the art.

Upon exiting the cleaner 12, the strip 10 travels through an annealing furnace 14, which may be provided with guide rollers 13 and heating and cooling zones (not shown). The operations of the annealing furnace 14 are also known in the art and endow the strip 10 with good formability.

Next, the strip 10 travels through a dipping bath 16 in which the strip is transferred through a bath of material which is desired to be coated on the surface of the strip. For example, the dipping bath 16 may be a zinc bath to provide a protective coating on the surfaces of the strip 10.

The strip 10 may then travel through a chemical treater 20, where the strip 10 is chemically treated to protect the coating from, for example, storage stains.

Finally, the strip 10 travels through a worker and leveller 22, where a uniform forming of the strip 10 is obtained. As known in the art, the treater 20 and the worker and leveller 22 may be provided with guide rollers (not shown) to guide the strip accordingly. Upon exiting the worker and leveller 22, the strip may be wound in a coil or otherwise used in further manufacturing operations.

When the steel strip 10 is to be zinc-coated by the hot dip process, the preheated strip 10 passes down into the bath 16, which contains molten zinc, where the surfaces of the strip 10 are coated. The bath 16 may contain a roller 24 to guide the strip 10 through the bath 16. The steel strip 10 is turned upwardly by one of the rollers 24 and leaves the bath 16 vertically.

On leaving the bath 16, the strip 10 is passed between opposed surfaces of air knives 26. The air knives 26 provide a continuous blast of high pressure air to the surface of the strip 10 to remove excess molten zinc from the strip 10. Upon exiting from the air knives 26, the zinc coating on the strip 10 is still in a liquid state.

The hot dip galvanizing industry has introduced the installation of a second annealing furnace 28 immediately above the air knives 26 where the zinc and its additives, if any, are further melted and alloyed to the strip 10 while passing through the annealing furnace 28. As the strip 10 exits the annealing furnace 28, the surface temperature of the strip 10 may be as high as 1100° F., which is far above the melting temperature of the zinc and its additives (the latter being below about 800° F.). The strip 10 then travels in a generally vertical direction toward tower roller 30.

In the present invention, in order to cool the strip 10 between the annealing furnace 28 and the tower roller 30, cooling headers 32 are provided. The cooling headers 32 are arranged in tandem, for example, with header 32*a* being positioned on one side of the traveling strip 10 and the second header 32*b* being positioned on the opposite side thereof. The headers 32 advantageously provide a continuous stream of low pressure, high velocity air directed to the surface faces of the strip 10. In the preferred embodiment of the present invention, the headers are provided with exit openings that direct air in a direction opposite to the travel of the strip 10 and at an angle thereto, as will be described hereinafter.

As shown in FIG. 1, each header 32 may have associated with it a deflector plate 36. The deflector plate 36 is positioned is close proximity to the strip 10 such as to collect air deflected from the strip 10 for the purposes hereinafter described.

As also shown in FIG. 1, there are three pairs of cooling headers 32. It should be appreciated the exact number of cooling headers may vary depending on such matters as, for example, the temperature of the strip 10 prior to and after the strip 10 passes the first headers 32*a* and 32*b*, the speed at which the strip 10 is traveling, the thickness of the strip 10, the thickness of the coating applied to the surface of the strip 10, and the extent to which it is desired to cool the strip 10 before it wraps around the tower roller 30. Consequently, the number of cooling headers shown in FIG. 1 is to be considered as exemplary only.

In the event it is desired to cool the strip 10 to a temperature lower than that obtained through the use of the headers 32*a* and 32*b*, or in the event some of the air that impinges upon the strip 10 from the cooling headers 32*a* and 32*b* becomes superheated and travels upwardly with the strip 10 at the speed of the strip 10, a second pair of cooling headers 32*c* and 32*d* can be provided.

One of each of the second pair of cooling headers 32*c* and 32*d* is positioned on either side of the strip 10 and the headers 32*c* and 32*d* discharge the low pressure, high velocity air against the faces of the strip 10 in a similar manner as the first pair of cooling headers 32*a* and 32*b*. The low pressure, high velocity air discharged from the second pair of cooling headers 32*c* and 32*d* has the ability to disrupt any thin layer of superheated air travelling adjacent the surface of the strip 10. The hot air deflected from the face of the strip 10 is guided away from the strip 10 by the deflector plates 36*b* positioned in close proximity to the strip 10.

If necessary, a third pair of cooling headers 32*e* and 32*f* can be provided to repeat the function of the second pair of cooling headers 32*c* and 32*d*. Additional pairs of cooling headers 32 can be provided depending on such matters as, for example, the desired degree of cooling, the thickness of the strip 10, the thickness of the zinc coating, the speed of the strip 10, and the like.

Each of cooling headers 32 introduces air at ambient temperatures in a substantially uniform velocity across a face of the strip 10. The cooling headers 32 are thus capable of reducing substantially the temperature of the strip 10 to well below the melting point of the zinc prior to the strip 10 making contact with the tower roller 30, thereby reducing to a significant degree the commonly-known problem of depositing zinc on the face of the tower roller 30 and smearing the zinc on the surface of the strip 10.

Figure 2:
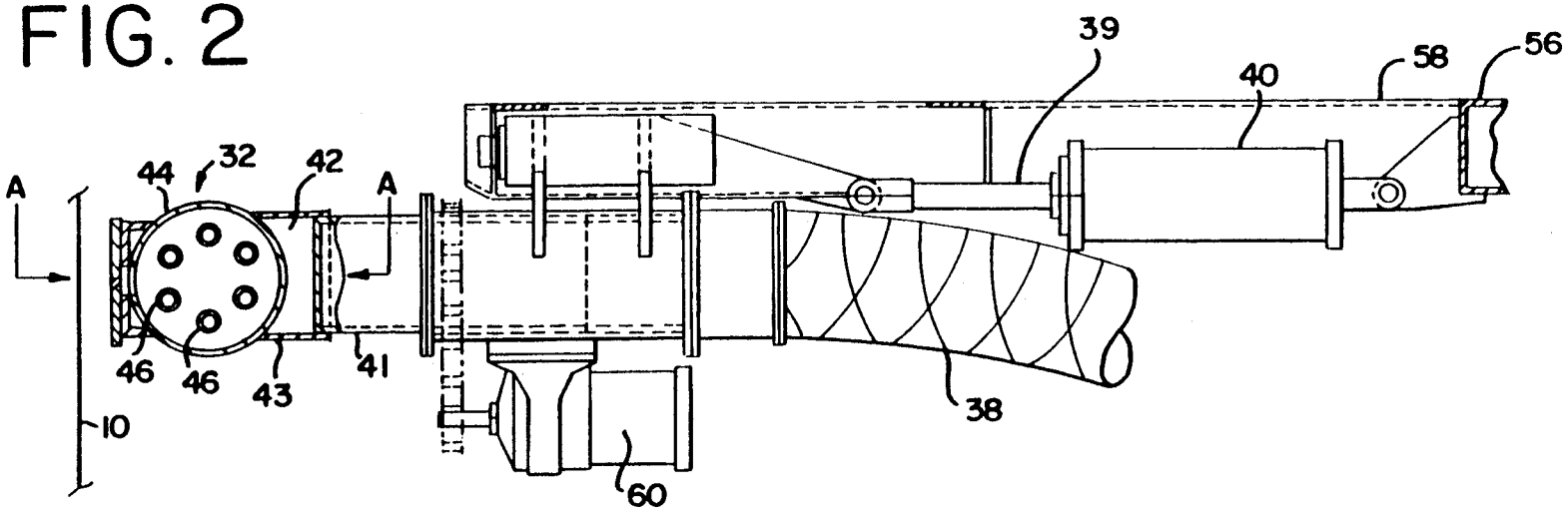
FIG. 2 is a partial cross-sectional view of a cooling header mounted in the continuous line of FIG. 1.

FIG. 2 depicts the positioning of one of the cooling headers 32 in a continuous coating line. The cooling header 32 is mounted to a structural steel beam 56, which may be associated with the coating line, by way of a support frame 58 (such mounting could be rigid, as by welding and the like, or movable, such as by a pivot) in such a manner that the headers 32 can be translated laterally, either through manual or motor drive, to travel toward or away from the strip 10. For example, a retractable cylinder 40, attached via shaft 39, can also be provided to allow the cooling header 32 to be moved laterally toward and away from the strip 10. This feature assures that upon start-up, when the mill is being threaded, no damage would occur to the cooling header 32 by the strip 10 that has no tension. After threading operations, the cooling header is translated into the cooling position from the "maintenance" position. Also, an adjust mechanism 60 can be used to fine tune the distance between the cooling header 32 and the strip 10. The adjust mechanism 60 can be chain drive motor although manual, screw-type or other mechanisms can also be used.

Each cooling header 32 receives air, preferably a continuous stream of low pressure air, from a blower or a fan (not shown) through a flexible wire-reinforced hose 38. The blower or fan can be any type of mechanism designed to move air and, preferably, is equipped with controls that permit the volume of air so moved to be adjusted as needed. The flexible hose 38 allows for the lateral movement of the cooling header 32.

Figure 3:
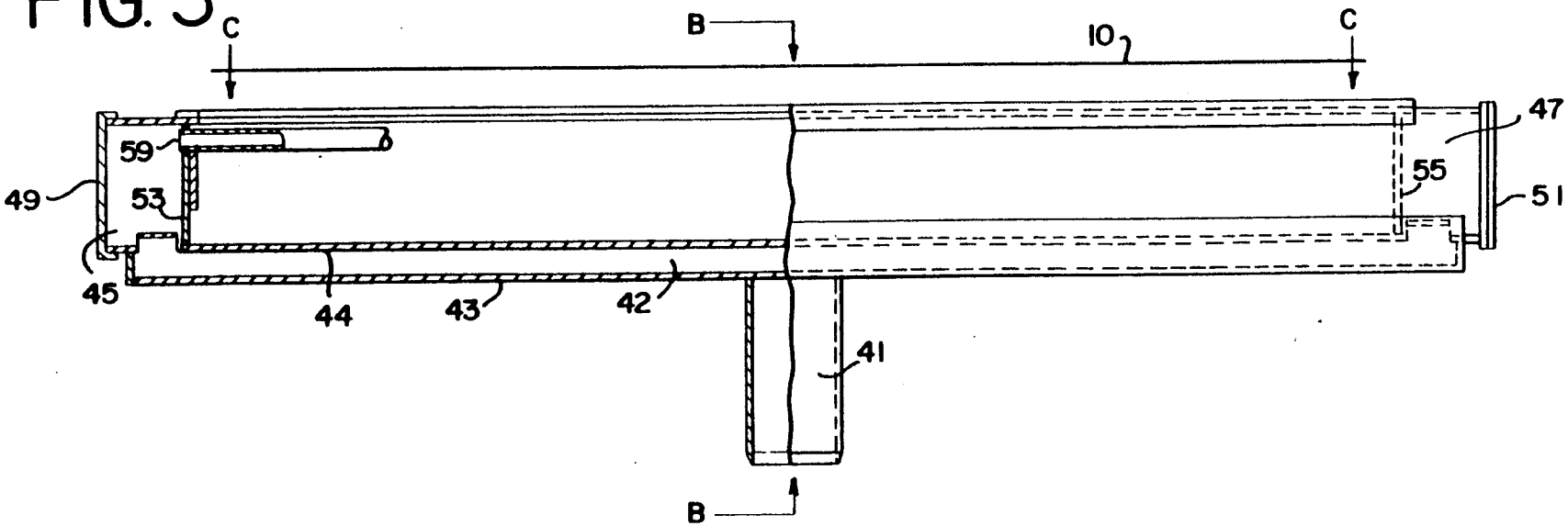
FIG. 3 is a partial cross-sectional top view taken along the lines A—A of a portion of the cooling header of FIG. 2.

From the wire-reinforced hose 38, the air enters into an air inlet 41 and then into a chamber 42 lying outside external pipe 44. Referring to FIG. 3, the chamber 42, extends along the longitudinal axis of the external pipe 44. The chamber 42, which may be formed by C-shaped member 43 (see FIG. 2), communicates with end chambers 45 and 47 fitted with caps 49 and 51, respectively, to form enclosures surrounding the ends of the external pipe 44. The ends of the external pipe are fitted with removable end plates 53 and 55. The end plates 53 and 55 are adapted to receive internal pipes 46 and hold those pipes in adjustable positions. The end plates 53 and 55 can also be provided with locking rings (not shown) and the like to allow the ready positioning of the internal pipes 46.

In FIG. 3, only a portion of one such internal pipe 46 is shown for clarity. Each end of each internal pipe 46 is fitted with inlets 59 which communicate with the chambers 45 and 47. Thus, air flowing into air inlet 41 is directed through chamber 42 and into chambers 45 and 47. Such air then enters inlets 59 of the internal pipes 46.

Figure 4:
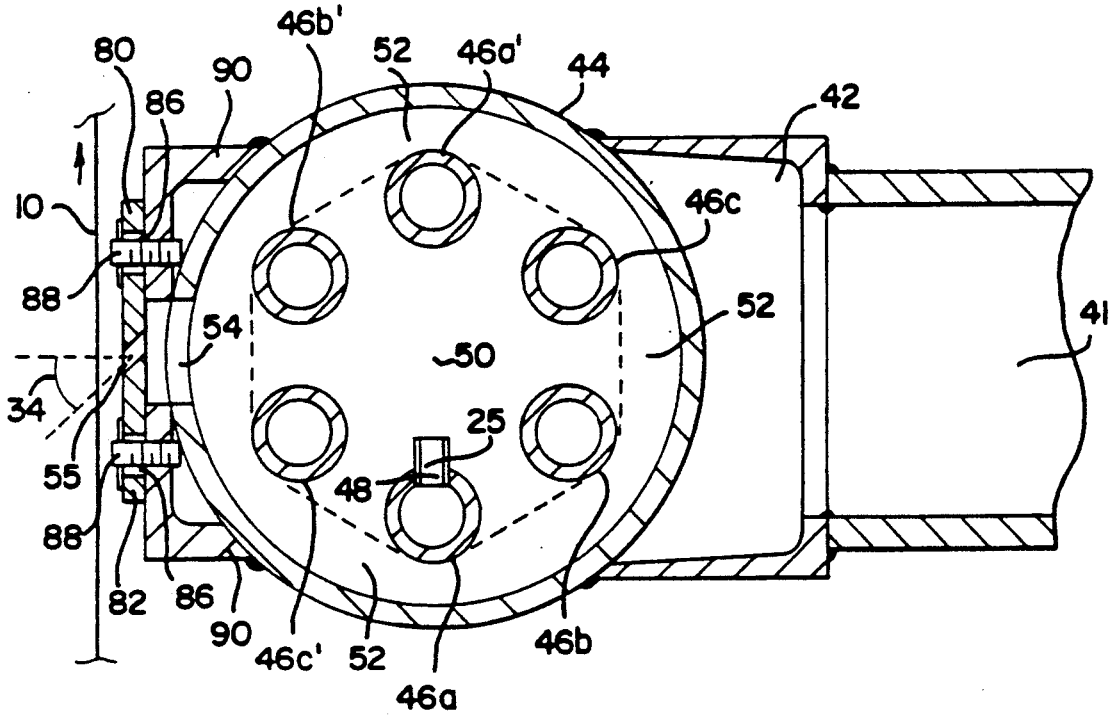
FIG. 4 is an enlarged, partial cross-sectional view of a portion of the cooling header of FIG. 3, taken along the lines B—B of FIG. 3.

Referring now to FIG. 3 and FIG. 4 together, an enlarged view of the cooling header 32 of the present invention is shown. FIG. 4 depicts a cross-sectional view, taken along the lines B—B of FIG. 3, of the cooling header 32. In the preferred embodiment of the present invention, a plurality of internal pipes 46 is arranged symmetrically inside the external pipe 44. Each internal pipe 46 has numerous discharge holes 48 (see FIG. 6) located at predetermined positions along the length of the internal pipes 46. If desired, the discharge holes 48 may be fitted with replaceable nozzles 25 so that the discharge holes 48 themselves do not become enlarged as high velocity air is discharged through them. It should be noted that in FIG. 4, only one such discharge hole 48 and nozzle 25 is shown for clarity.

When the internal pipes 46 are positioned within the external pipe 44 for use in the cooling header 32 of the present invention, the discharge holes 48 are aligned to discharge air toward the central region 50 of the external pipe 44. The central region 50 lies along the longitudinal axis of the external pipe 44.

As noted, each inlet 59 of the internal pipes 46 is open and constitutes a passage for air from the chambers 45 and 47 to the internal pipes 46. It has been found that the present invention provides advantageous cooling to the strip 10 when the total area of the inlets 59 of the internal pipes 46 is greater than the total area of the discharge holes 48, of if the holes 48 are equipped with nozzles 25, the total area of the inlets 59 be greater than the total area of the orifices of the nozzles 25. Such configuration creates a back pressure in each of the internal pipes 46 to provide a uniform velocity and pressure of the air flowing through the discharge holes 48.

The central region 50 inside the cluster created by the internal pipes 46 receives the incoming air, already uniformly distributed throughout the length of the chamber 42. The air exits this region 50 between the internal pipes 46 and enters a raceway 52 defined as the zone between the outer circumference of the internal pipes 46 (shown by the dashed lines in FIG. 4) and the inside circumference of the external pipe 44. Such air travels in the raceway 52 toward the exit opening 54 in a high, uniform velocity. The exit opening 54 communicates with exit 55, which is adapted to direct the air toward the strip 10 at an angle in relation to the direction of travel of the strip 10.

As noted in FIG. 4, the internal pipes 46 are arranged symmetrically inside the external pipe 44, with each pipe having a corresponding mate lying along a diameter of the external pipe 44. While FIG. 4 shows six separate internal pipes 46 (i.e., 46*a* and 46*a'*, 46*b* and 46*b'*, 46*c* and 46*c'*), il should be appreciated that the exact number may vary from application to application, depending on such nonlimiting factors as the diameter of the external pipe and the diameter of the internal pipes, the desired velocity of air being discharged through exit 55, among other things.

As noted, each of the internal pipes 46 has a plurality of spaced apart discharge holes 48 positioned along a portion of the length of the internal pipe 46, with the internal pipes 46 being located within the external pipe 44 such that the discharge holes 48 aim toward the central region 50 of the external pipe 44.

Figure 6:
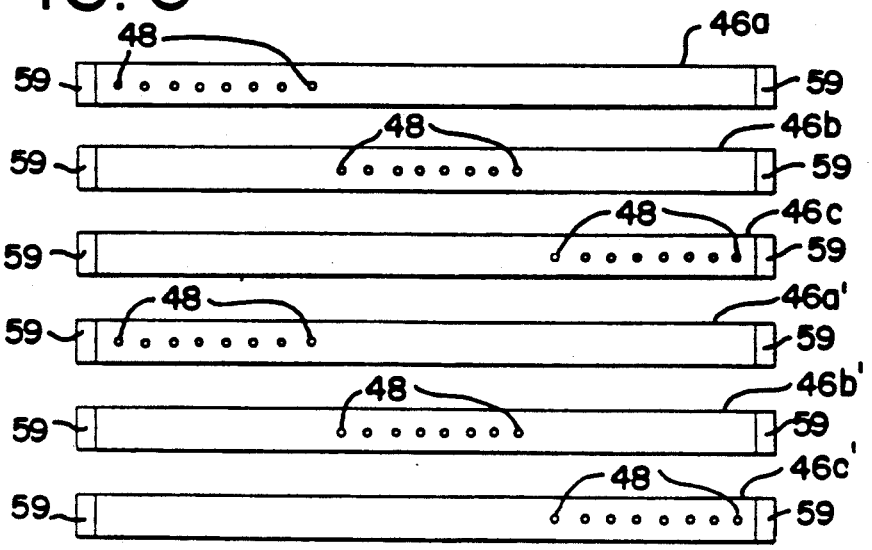
FIG. 6 is a partial plan view of the internal pipes and the discharge holes of the cooling header of the present invention.

FIG. 6 depicts one embodiment of the location of the holes 48 in the internal pipes 46 of FIG. 4. As there noted, the holes 48 of internal pipe 46*a* are located toward one end of the pipe 46*a*. For internal pipe 46*b*, the holes 48 are located along the central region of the pipe. The holes of internal pipe 46*c* are located toward the end of the pipe 46*c* opposite to that of pipe 46*a*. Internal pipe 46*a'* repeats the pattern of holes 48 found in pipe 46*a*, internal pipe 46*b'* repeats the pattern of pipe 46*b*, and internal pipe 46*c'* repeats the pattern of pipe 46*c*. Such alternating repeat pattern advantageously provides a generally uniform mixing of air in the central region 50. In addition, it is preferred that all of the holes 48 be of substantially the same diameter, or if the holes 48 are equipped with the nozzles 25, all of the nozzles have substantially the same orifice size. Also, it is preferred that the center-point of the holes 48, or alternatively the nozzles 25 if they are used, be spaced apart by substantially the same distance along each internal pipe 46 and from one pipe to the next. The exact number of discharge holes 48 in each internal pipe 46 may vary from one application to the next, depending on such matters as the lengths of the pipes 46, etc. It has been found that eight such holes in an internal pipe of length of about 38 inches provides a uniform velocity of air in the raceway 52. While FIG. 6 depicts an embodiment of the location of the discharge holes 48 in internal pipes 46, it will be appreciated that the exact locations can vary from that shown. For example, internal pipe 46*a* could contain two groups of holes 48, with each group spaced apart Likewise, pipes 46*b* and 46*c* could each also contain two groups of holes 48, also spaced apart. In order to impact the uniform velocity to the air stream, it is only necessary to ensure that the holes in each group be spaced apart by substantially the same distance along each internal pipe 46 and from one pipe to the next so that a repeat pattern is formed, with internal pipe 46*a'* repeating the pattern of pipe 46*a*, pipe 46*b'* repeating the pattern of pipe 46*b*, and pipe 46*c'* repeating the pattern of pipe 46*c*.

The purpose of the cooling header 32 is to discharge a stream of low pressure, high velocity air to the surface of the strip 10. In the preferred embodiment, this air stream is at a uniform velocity and a uniform pressure. In this regard, in addition to the back-pressure created in the pipes 46, it is advantageous to provide a back-pressure throughout the entire header 32.

To create this back-pressure in the air to form uniform pressure and uniform velocity, the total area of the air inlet 41 must be greater than the total area of the exit 55.

As noted, the central region 50 of the external pipe 44 receives air, which is uniformly distributed throughout the length of the region 50, from the discharge holes 48. The uniformly mixed air leaves the area of the central region 50 of the internal pipes 46 and enters the raceway 52. The air travels in the raceway 52 toward the exit opening 54 in a high uniform velocity. The air exits the exit opening 54 an through exit 55 which is positioned at an angle 34 with respect to the direction of travel of the strip 10. As shown in FIG. 4, this angle is determined by the angle between a plane lying perpendicular to the strip 10 and passing through the longitudinal axis of the external pipe 44 and a plane that is tangent to the external pipe 44 at a point closest to the strip 10. Preferably the angle 34 is less than 90°; more preferably the angle 34 is between about 15° and 45°. Most preferably, the angle 34 is between about 15° and 30°. As also shown in FIG. 4, the exit 55 is aligned at the angle 34 that is against the direction of travel of the strip 10. Such alignment effectively increases the velocity of the air being discharged from the exit 55 due to the speed at which the strip is travelling and permits an efficient cooling of the strip 10. Alternatively, in certain operations it may be desirable to align angle of the exit 55 in the direction of travel of the strip 10 (i.e., opposite to that shown in FIG. 4). That can easily be accomplished, as will be appreciated by one skilled in the art.

Figure 5:
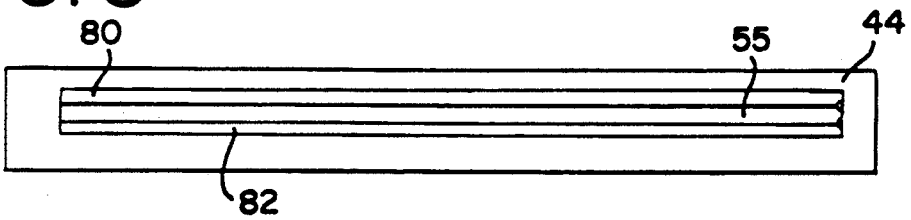
FIG. 5 is an end view of FIG. 3, taken along the lines C—C of FIG. 3, with the strip 10 removed for clarity.

The exit 55 is in the form of a slot which extends along the length of the external pipe 44 (see FIG. 5). In use, it is preferred that the length of the exit be greater than the width of the strip 10. Although the exit 55 shown in FIG. 5 has the longer sides being substantially parallel, it should be appreciated that the exit 55 can be shaped as a gradual arc, with the wider portions thereof lying toward each end of the exit 55. Such shape would provide a stream of air leaving generally the ends of the exit 55 having a slightly lower velocity than that leaving the mid portion thereof. This shape would facilitate the cooling of the mid portion of the strip 10 at a rate generally consistent with the cooling of the end portions of the strip 10, keeping in mind that the ends of the strip 10 may cool faster due to known heat transfer mechanisms.

The size of the opening of the exit 55 may be adjusted by translating plates 80 and 82 along slots 84 and 86, respectively. Plates 80 and 82 may be removably attached by bolts 88 to L-shaped members 90. L-shaped members 90 are attached to external pipe 44 by any convenient method, such as welding.

In the preferred embodiment, the air velocity as it leaves the exit 55 is approximately between about 6,000 and about 12,000 feet/minute at pressures ranging from about 3 p.s.i. to about 12 p.s.i., with the exact velocity dependent on such factors as the speed of the traveling strip 10, the temperature of that strip, the distance between the exit end of the annealing furnace 28 and the tower roller 30, and the desired cooling to be imparted to the strip 10, among other factors. Furthermore, when a boundary layer of superheated air is traveling with the strip 10, the velocity of the air impinging on strip 10 must be sufficient to cut through this boundary layer. It has been determined that an air velocity of about 6,000 feet/minute and above is effective to accomplish this task. However, when the coating on the strip 10 is in the molten or "soft" state, the velocity of the air should not be so great as to disturb the surface of the coating by any significant degree. In this regard, it has been determined that an air velocity of about 12,000 feet/minute or less is acceptable to achieve this purpose.

The use of multiple cooling headers 32 also assists in the efficient cooling of the strip 10. For example, with reference to FIG. 1, the velocity of the air flowing from the headers 32*a* and 32*b* could be about 6,000 feet/minute to initially cool the strip 10 without significant disturbance to the coating on the surface of the strip 10. The headers 32*c* and 32*d*, being spaced apart from headers 32*a* and 32*b* by some distance, could be operated to discharge air at about 7,000 feet/minute. The headers 32*e* and 32*f*, being spaced apart from headers 32*c* and 32*d* by some distance, could be operated to discharge air at about 8,000 feet/minute. Additional headers could likewise be operated at higher air velocity; of course, the exact air velocity from any one or more pairs of headers is dependent on the operational configuration of the line and the desired cooling results.

When the apparatus of the present invention is used, the cooling header 32 can be positioned such that the exit 55 is about six inches from the strip 10, or at such other closer or farther distance as may be required for efficient cooling of the strip 10. Such positioning can be made by use of the retractable cylinder 40 or the adjust mechanism 60 or both.

As previously noted, each header 32 may have an associated deflector plate 36. The deflector plates serves to collect air deflected off of the strip 10. Each deflector plate 36 can also be provided with a series of heat exchange tubes through which a fluid, such as water, flows. Thus, because the air deflected off of the strip 10 is at a temperature approximating that of the strip 10, such deflector plates 36 equipped with heat exchange capability can conserve plant energy requirements. For example, such could be used to generate steam for use in other operations in the plant.

These and other advantages of the present invention will be readily apparent to one skilled in the art.

While the foregoing invention has been shown and described with reference to the attached drawings and a preferred embodiment, it will be appreciated that modifications and changes to the foregoing can be made while still falling within the intent and spirit of the invention.

What is claimed is:

1. An apparatus for cooling the surface of a traveling strip of heated material, comprising at least one pair of header means, with each of said at least one pair of header means comprising a first cooling header and a second cooling header, with said first cooling header and said second cooling header being positioned in spaced apart relation and lying on opposite sides of the traveling strip, each cooling header being provided with an air exit to be positioned adjacent the traveling strip through which an air stream is discharged, each cooling header including a first chamber communicating through an air passage with a source of air, an external pipe having end plates and an opening communicating with said exit, said external pipe having a longitudinal axis lying centrally through the length thereof with said external pipe having an interior wall and an exterior wall, a second chamber located at each end of said external pipe and communicating with said first chamber, a plurality of internal pipes disposed within said external pipe such that said internal pipes define an interior circumference and an exterior circumference, each of said internal pipes having inlets communicating with said second chamber through said end plates, each of said internal pipes further having a plurality of discharge holes disposed along at least a portion of the length of said internal pipes with said discharge holes being positioned to direct an air stream toward a region of said external pipe lying along the central longitudinal axis of said external pipe, a raceway lying between the interior wall of said external pipe and the exterior circumference of said internal pipes and adapted to receive an air stream from said region of said external pipe and discharge the air through said opening and said exit.

2. The apparatus of claim 1, further including a drive operably connected to each such cooling header to translate said cooling header toward and away from the traveling strip.

3. The apparatus of claim 1, wherein said exit comprises a slot positioned along at least a portion of the length of said external pipe.

4. The apparatus of claim 3, wherein said slot has substantially parallel sides lying along the length of said external pipe.

5. The apparatus of claim 3, wherein said slot has sides lying along the length of said external pipe, such sides being of opposed arcuate shape.

6. The apparatus of claims 1 or 3, wherein the width of said exit is adjustable.

7. The apparatus of claims 4 or 5, wherein the width of said slot is adjustable.

8. The apparatus of claims 1 or 3, wherein said exit is at an angle with respect to the direction of travel of the traveling strip.

9. The apparatus of claim 8, wherein said angle is defined as lying between a plane perpendicular to the traveling strip and passing through the central longitudinal axis of said external pipe and a line tangent to the outer circumference of said external pipe at a point closest to said strip and wherein said angle is between 15° and 45°.

10. The apparatus of claim 9, wherein said angle lies in the direction opposite the direction of travel of the strip.

11. The apparatus of claim 9, wherein said angle lies in the direction of travel of the strip.

12. The apparatus of claim 1, wherein the total area of said inlets is greater than the total area of said discharge holes and the area of said air passage is greater than the area of said exit.

13. An apparatus for cooling the surface of a traveling strip of heated material, comprising at least two pairs of cooling header means comprising a first set of cooling headers and a second set of cooling headers, with said first set of cooling headers and said second set of cooling headers being positioned in spaced apart relation and lying on opposite sides of the traveling strip, each cooling header being provided with an air exit to be positioned adjacent the traveling strip through which an air stream is discharged, each said cooling header including: a first chamber communicating through an air passage with a source of air, an external pipe having end plates and an opening communicating with said exit, said external pipe having a longitudinal axis lying centrally through the length thereof with said external pipe having an internal wall and an exterior wall, a second chamber located at each end of said external pipe and communicating with said first chamber, a plurality of internal pipes disposed within said external pipe such that said internal pipes define an interior circumference and an exterior circumference, each of said internal pipes having inlets communicating with said second chamber through said end plates, each of said internal pipes further having a plurality of discharge holes disposed along at least a portion of the length of said internal pipes with said discharge holes being positioned to direct an air stream toward a region of said external pipe lying along the central longitudinal axis of said external pipe, a raceway lying between the interior wall of said external pipe and the exterior circumference of said internal pipes and adapted to receive an air stream from said region of said external pipe and discharge the air through said opening and said exit, with said exit being positioned at an angle with respect to the traveling strip, and wherein in each such cooling header the total area of said inlets is greater than the total area of said discharge holes and the area of said air passage is greater than the area of said exit.

14. The apparatus of claim 13, further including a drive operably connected to each said cooling header to translate each said cooling header toward and away from the traveling strip and wherein said exit of each said cooling header comprises a slot positioned along at least a portion of the length of said external pipe.

15. The apparatus of claims 14, wherein the width of said slot is adjustable and wherein said angle is defined as lying between a plane perpendicular to the traveling strip and passing through the central longitudinal axis of said external pipe and a line tangent to the outer circumference of said external pipe at a point closest to said strip and wherein said angle is between 15° and 45°.

16. The apparatus of claim 9, wherein said angle is between 15° and 30°.

17. The apparatus of claim 15, wherein said angle is between 15° and 30°.

18. The apparatus of claims 1 or 13, further including a deflector plate positioned to receive air deflected from the surface of the traveling strip, said deflector plate being equipped with heat exchange means.

19. The apparatus of claims 1 or 13, wherein the air discharged through said exit is at a substantially uniform velocity across the length of said exit.

20. The apparatus of claim 19, wherein the velocity of air discharged through said exit is between about 6,000 feet per minute and 12,000 feet per minute.

* * * * *

UNITED STATES PATENT AND TRADEMARK OFFICE

CERTIFICATE OF CORRECTION

PATENT NO. : 5,186,885

DATED : February 16, 1993

INVENTOR(S) : George C. Perneczky

It is certified that error appears in the above-indentified patent and that said Letters Patent is hereby corrected as shown below:

In column 1, line 47, delete "highpressure" and insert therefor --high pressure--

In column 2, line 61, delete "100° F" and insert therefor --1100° F--

In column 5, line 14, after "is positioned" delete "is" and insert --in--

In column 7, line 9, after "holes 48" delete "of" and insert --or--

In column 7, line 34, delete "il" and insert therefor --it--

In column 8, line 36, after "exit opening 54" delete "an" and insert --and--

In claim 13, column 11, line 22, after "having an" delete "internal" and insert therefor --interior--

Signed and Sealed this

Eighth Day of February, 1994

Bruce Lehman

*Attest:*

BRUCE LEHMAN

*Attesting Officer*

*Commissioner of Patents and Trademarks*